US005370735A

United States Patent [19]

Beisswanger

[11] Patent Number: 5,370,735

[45] Date of Patent: Dec. 6, 1994

[54] ROLL-COATING MACHINE FOR APPLYING COATING COLORS ONTO A PAPER WEB

[75] Inventor: Rudolf Beisswanger, Steinheim, Germany

[73] Assignee: J. M. Voith GmbH, Heidenheim, Germany

[21] Appl. No.: 20,769

[22] Filed: Feb. 22, 1993

[30] Foreign Application Priority Data

Feb. 21, 1992 [DE] Germany ..... 4205312

[51] Int. Cl.[5] ..... B05C 1/12

[52] U.S. Cl. ..... 118/249; 118/72; 118/410; 427/428; 101/366

[58] Field of Search ..... 118/72, 63, 249, 258, 118/262, 252, 410; 427/428; 101/363, 350, 366

[56] References Cited

U.S. PATENT DOCUMENTS 3,461,837 8/1969 Dreher ..... 118/262
4,538,541 9/1985 Zimmer ..... 118/262 X
5,058,502 10/1991 Köbler et al. ..... 101/366 X

FOREIGN PATENT DOCUMENTS

3605409A1 8/1987 Germany .

*Primary Examiner*—Michael W. Ball
*Assistant Examiner*—Francis J. Lorin
*Attorney, Agent, or Firm*—Marshall, O'Toole, Gerstein, Murray & Borun

[57] ABSTRACT

The invention concerns a roll-coating machine for the application of coating colors onto a paper web, including:

a coating roll that rotates in a coating color pool;

a trough retaining the color pool and having a coating color inlet, a guide wall with a first overflow edge, and an overflow channel for a first overflow stream;

a mating roll that rotates in a direction opposite to that of the coating roll and with it forms an inlet gusset and an outlet gusset; and a guide shield that has a second overflow edge on its downstream end for a second overflow stream, a bypass channel for division of the second overflow stream and having a valve, and a restrictor defined by the guide shield in cooperation with the paper web.

6 Claims, 8 Drawing Sheets

ROLL-COATING MACHINE FOR APPLYING COATING COLORS ONTO A PAPER WEB

BACKGROUND OF THE INVENTION

1. Field of the Invention

The invention is directed to a roll-coating machine for applying coating colors onto a paper web.

2. Description of Related Technology

One type of known roll-coating machine for applying a uniform coat of coating color(s) onto a paper web is disclosed in DE-OS 36 05 409 (Aug. 27, 1987) and includes (a) a coating roll that rotates in a coating color pool received in a trough that has a coating color inlet, a guide wall in the ascending region of the coating roll with a first overflow edge, and an overflow channel connected to the overflow edge for a first overflow stream, (b) a mating roll that is wound with a paper web and rotates in a direction opposite that of the coating roll and defines inlet and outlet gussets in cooperation with the coating roll, and (c) a machine-wide guide shield that extends into the inlet gusset, defines a flow channel in cooperation with the surface of coating roll, and has a second overflow edge for a second overflow stream on its downstream end.

Problems develop in such roll-coating machines mostly in the wedge-shaped inlet zone between the coating roll and the mating roll, especially at high speeds. This is largely attributable to the effect of air, which may be entrained into the inlet gusset during rotation of the mating roll together with the paper web. When this happens the air mixes with the coating color at the site where the color contacts the paper web. An overflow stream of coating color generally forms on the upper edge of the guide shield opposite the running direction of the paper web and opposite the air stream. If the air stream collides with this overflow stream, this leads to partial repulsion of the overflow stream, as well as mixing of air and coating color.

Disturbances of this type also occur if no guide shield is provided and if, as a result, a free surface of coating mass appears between the surface of the coating roll and the wall of the trough.

It would be desirable that the paper web and the coating color form a straight contact line on joining. However, owing to the described effect of entrained air, such contact is often not linear, but rather tongue-shaped. This is true of roll-coating machines with guide shields as described above and therefore of roll-coating machines with a free surface. If persistent air inclusions are retained over the entire coating zone, the paper web is not wetted at all by the coating color at the sites in question and remains uncoated at these sites. This is of course extremely undesirable.

An additional important requirement is that the coating color be fed in sufficient amount to the inlet gusset and thus the paper web, starting from an essential minimum amount to a maximum amount.

SUMMARY OF THE INVENTION

It is an object of the invention to overcome one or more of the problems described above.

According to the invention a roll-coating machine of the type described above is designed such that the interfering air effects in the inlet gusset are avoided. In addition, the coating color should be uniform in flow over the entire machine width, i.e., it should run in the machine direction. Crossflows are undesirable, and are avoided above all in the contact zone (in the inlet gusset). In particular, the contact line on joining of the paper web and the coating color stream is linear. Air inclusions are avoided in each case.

Accordingly, the guide shield of a roll-coating machine of the invention is designed as follows:

(a) it has a bypass channel to divert the second overflow stream;

(b) together with the paper web (seen in the direction of rotation of the mating roll in front of the bypass channel) it forms a restrictor at which a third overflow edge can be provided for a third overflow stream; and, (c) the bypass channel is provided with a valve, which is preferably controllable.

These measures make certain that the troublesome region of the inlet gusset is brought under control. A hermetically sealed system is created in this region in which entry of air into the actual coating zone is reliably avoided by two barriers, namely, the second and third overflow edges.

Other objects and advantages of the invention will be apparent to those skilled in the art from a review of the following detailed description, taken in conjunction with the drawings and the appended claims.

DETAILED DESCRIPTION OF THE INVENTION

Figure 1:
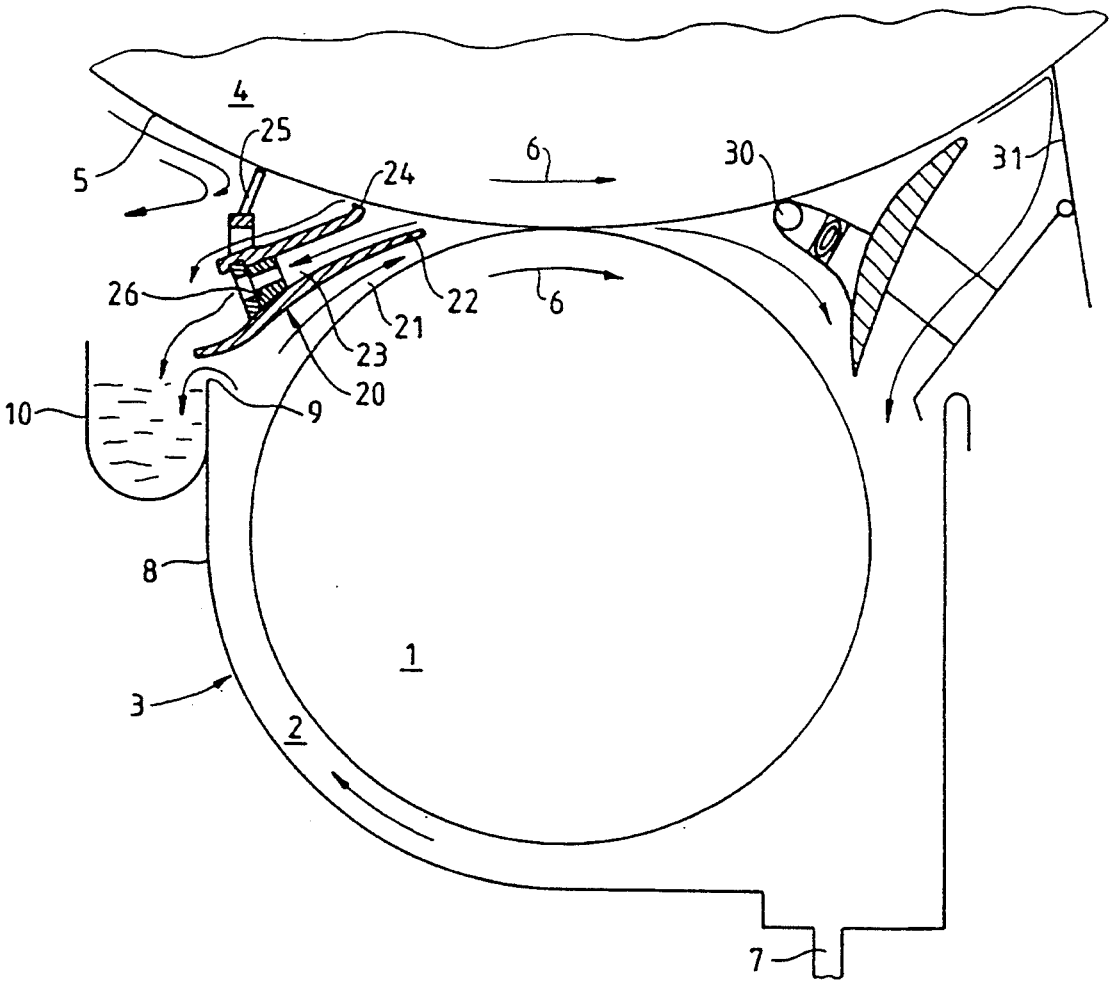
FIG. 1 shows a roll-coating machine of the invention in a side view.

The roll-coating machine of the invention depicted in FIG. 1 includes a coating roll 1 which rotates in a coating color pool 2 situated in a trough 3. A mating roll 4 wrapped with a paper web 5 is disposed adjacent to the coating roll 1. The rolls 1 and 4 run in opposite directions (i.e. in the direction of the arrows 6), but not at the same rotational speed (e.g. $v_{mating\ roll}:v_{coating\ roll}=10$). The area between the rolls 1 and 4 leading to and from the nip of the rolls respectively define a wedge-shaped inlet gusset or a nip entrance zone (on the left side of FIG.1), and a wedged-shaped outlet gusset or a nip exit zone (one the right side of the drawing).

The trough 3 has a coating intake 7. In the ascending region of the coating roll 1 a wall 8 of the trough acts as a guide wall and ends with a first overflow edge 9. An overflow channel 10 for a first overflow stream is connected to the first overflow edge 9.

A machine-wide guide shield 20 is connected to the guide wall 8 at a position following the overflow edge 9 (in the direction of rotation of the coating roll) and extends into the inlet gusset. The guide shield 20 thus defines a flow channel 21 in cooperation with the surface of the coating roll 1. On its downstream end the guide shield defines a second overflow edge 22 for a second overflow stream.

According to the invention the guide shield 20 defines a bypass channel 23 that serves to divert a second overflow stream. The second overflow stream develops due to the fact that excess coating color flows over the overflow edge 22 and through the bypass channel 23 against the direction of flow in the flow channel 21.

The position of the entire guide shield 20 can be varied. In particular the guide shield 20 may be designed to swivel about a pivot point or axis lying in the region of the overflow edge 22 and parallel to the axis of rotation of the coating roll.

The guide shield 20 also has a restrictor 24 that can serve as an overflow edge and in such case forms a third overflow edge. The restrictor also carries an air doctor 25. The flow channel 23 is provided with a valve 26 on its downstream end.

The three overflow streams that flow over the overflow edges 9, 22 and 24 all discharge into a single collection channel, i.e. the overflow channel 10.

After passing through the coating zone defined between the rolls 1 and 4 the coated paper web 5 reaches the outlet gusset where it runs past an equalizer rod 30 and finally a doctor blade 31. However, this region is not of primary significance for purposes of the invention.

The roll-coating machine according to the invention therefore operates as follows: The coating roll 1 takes up coating color from the coating color pool 2 during its rotation in the direction of the arrow 6. This leads to flow of the coating color along the guide wall 8 of the trough 3, and continues into flow channel 21. In the coating region (left side of FIG. 1) fully obvious and controlled conditions predominate. The entire space between the surface of the coating roll 1 in its rising, upper quadrant and the guide shield 20 is hermetically sealed. The paper web 5 entrains air during rotation of the mating roll 4 downward from the upper left of FIG. 1. However, this air encounters a first air barrier in the form of air doctor 25. Should the air overcome this barrier, it reaches the overflow edge 24 which represents an additional barrier. The overflow edge 22 of the guide shield 20 represents a final barrier to the flow of entrained air.

Figure 2:
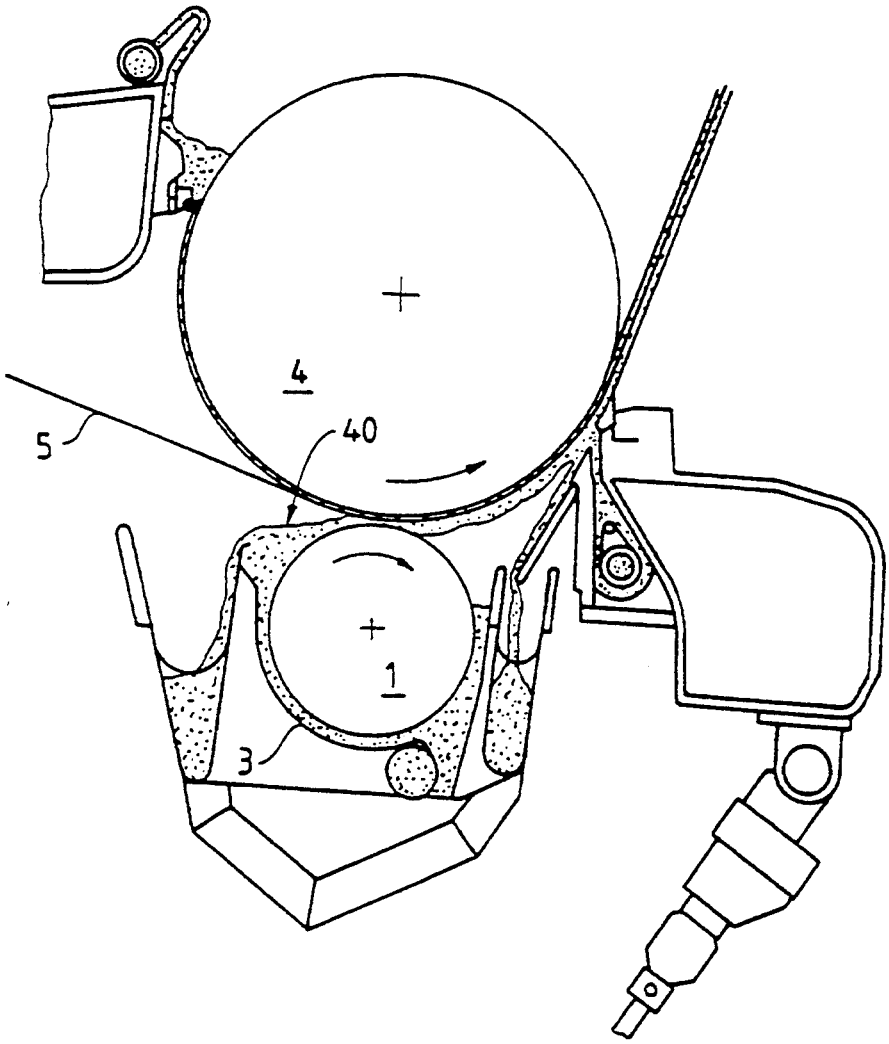
Fig.2 PRIOR ART
FIG. 2 shows a roll-coating machine according to the prior art in a side view.

In contrast, FIG. 2 shows a roll-coating machine according to the state of the prior art. Here as well the basic elements are present, namely a coating roll 1, a mating roll 4, a trough 3, etc. However, a guide shield designed according to the invention is lacking. In its place is a surface 40 of the coating color pool. This surface is subject to the effect of air masses entrained at high speed. The air penetrates the coating mass and passes through the coating zone with the paper web and the coating mass. The resulting coating on the paper web is unsatisfactory.

Figure 3:
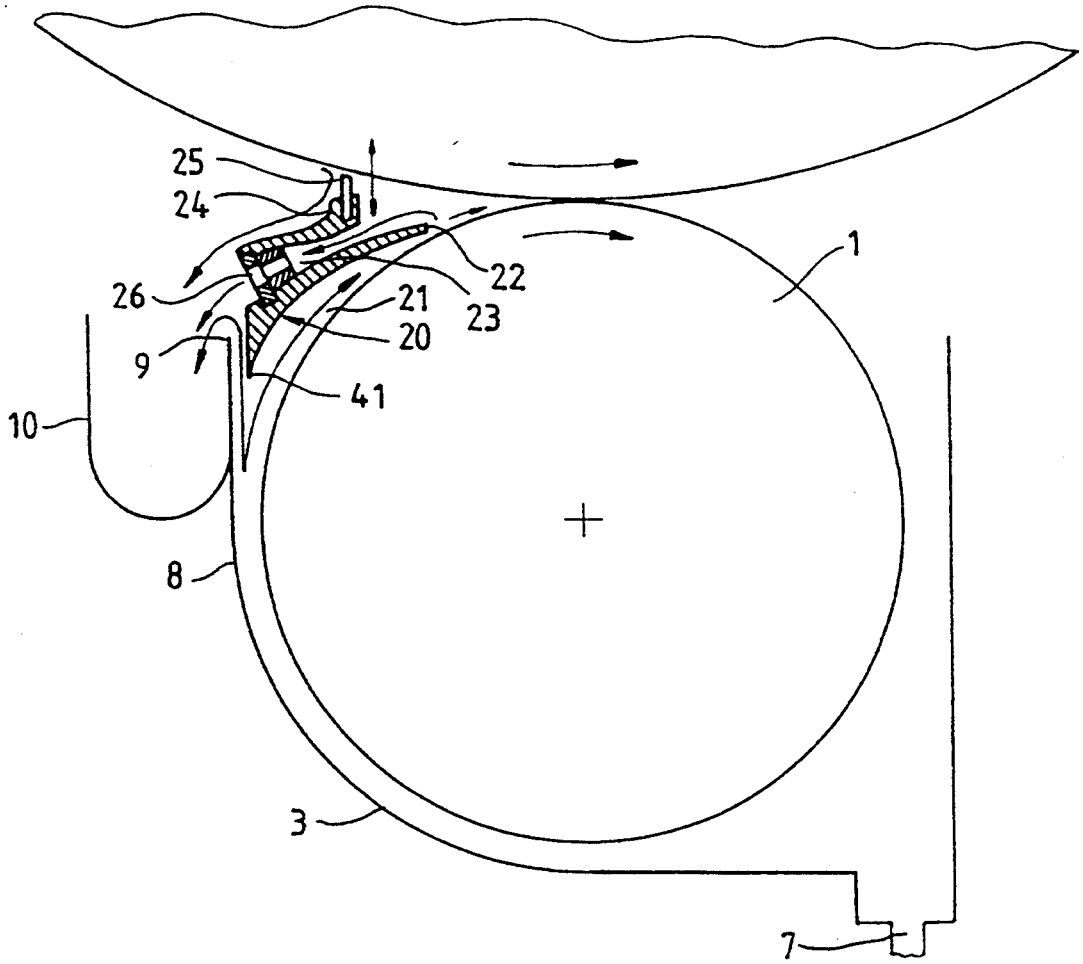
FIG. 3 shows a second embodiment of a roll-coating machine of the invention, again in a side view.

The embodiment of a roll-coating machine according to the invention depicted in FIG. 3 has essentially the same elements as the roll-coating machine of FIG. 1, with, however, a guide shield 20 that plunges with a pointed edge 41 into the space defined between the surface of the coating roll 1 and the guide wall 8 of the trough 3 and thus has a stream-divider action dividing the coating color, as shown by the two connected arrows, into a first overflow stream flowing towards the overflow edge 9 and another stream flowing into the flow channel 21. Like the embodiment in FIG. 1, excess coating color forming a second overflow stream flows in the direction of the arrow over the overflow edge 22 and through the bypass channel 23 against the direction of flow in the flow channel 21. The bypass channel is equipped with a valve 26 that is preferably controllable. The guide shield also has a restrictor 24 that carries an air doctor 25 that can serve as a third overflow edge.

Figure 4:
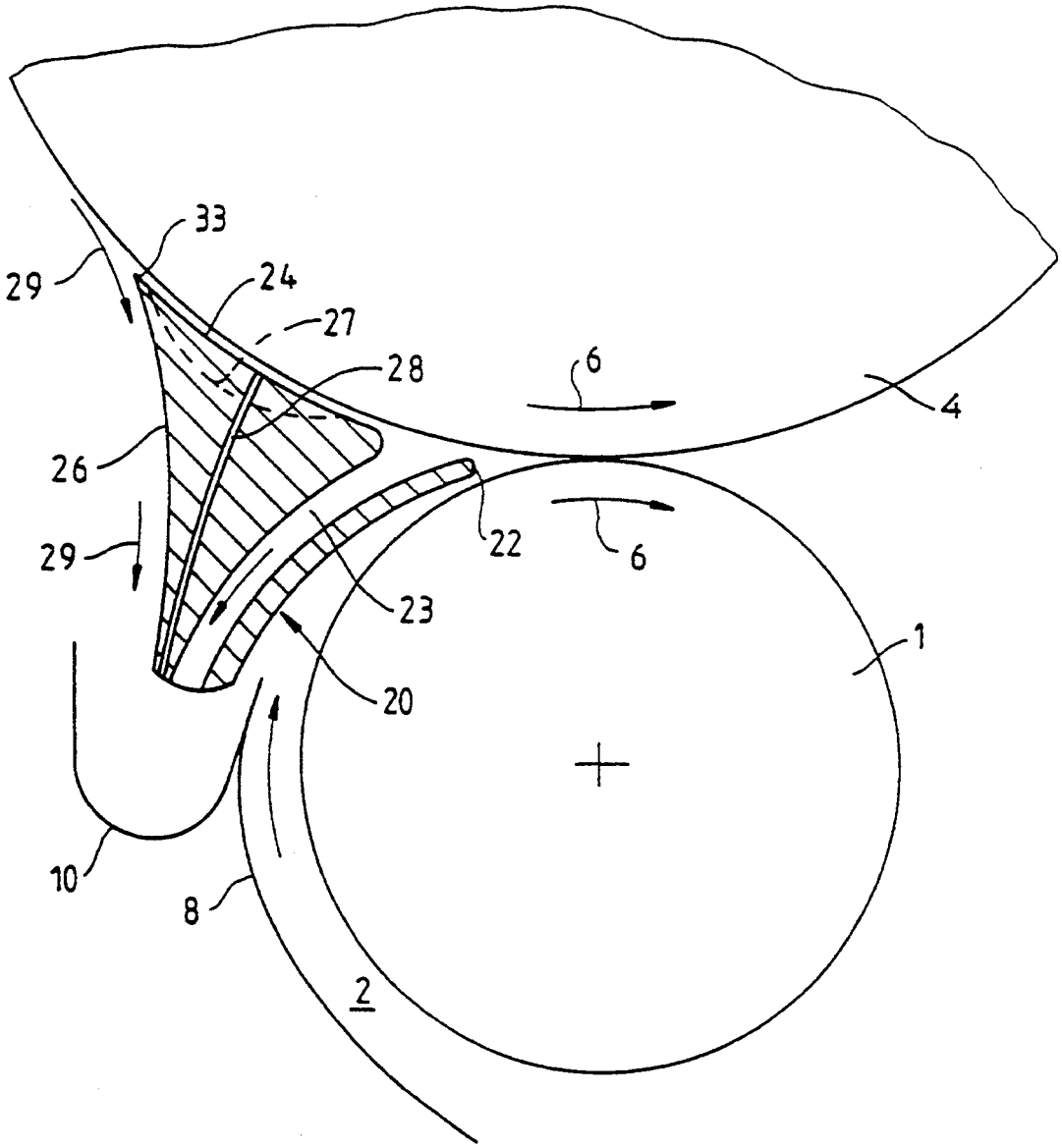
FIG. 4 shows a detail of a third embodiment of a roll-coating machine of the invention.
Figure 5:
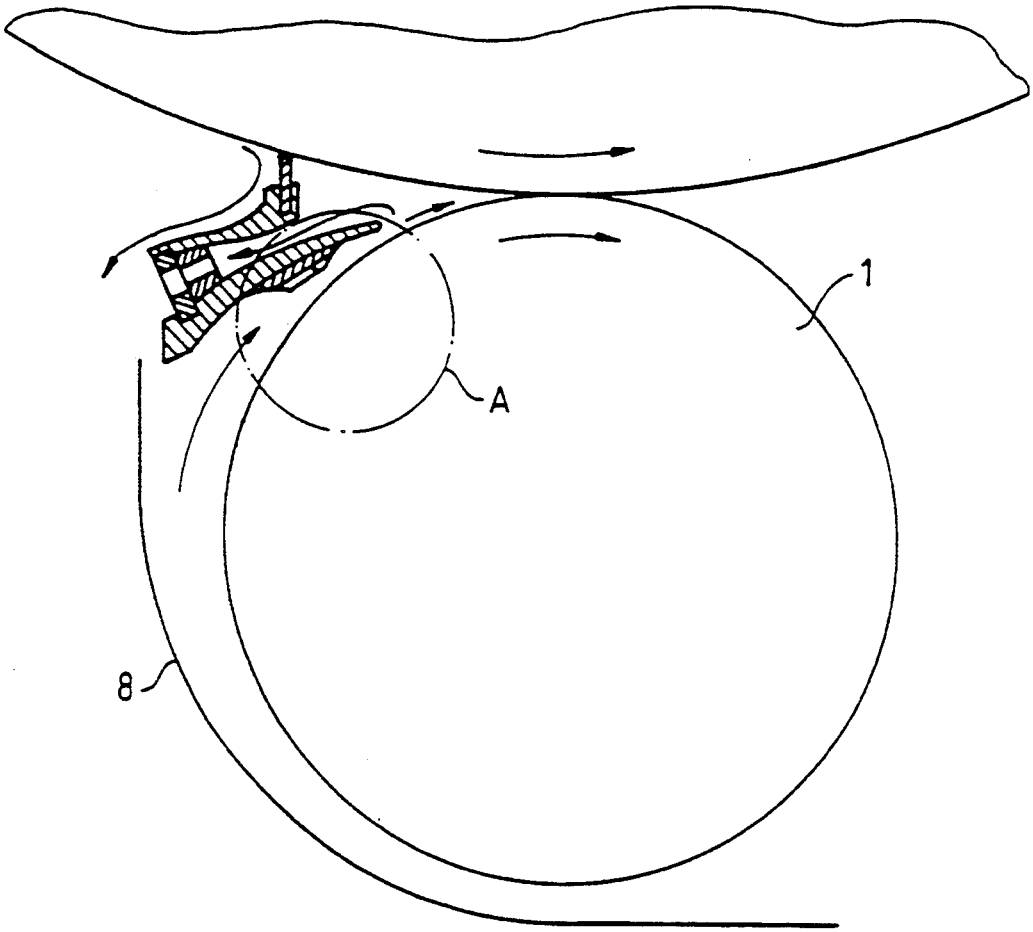
FIG. 5 shows a schematic side view of a fourth embodiment of a coating machine of the invention.
Figure 6:
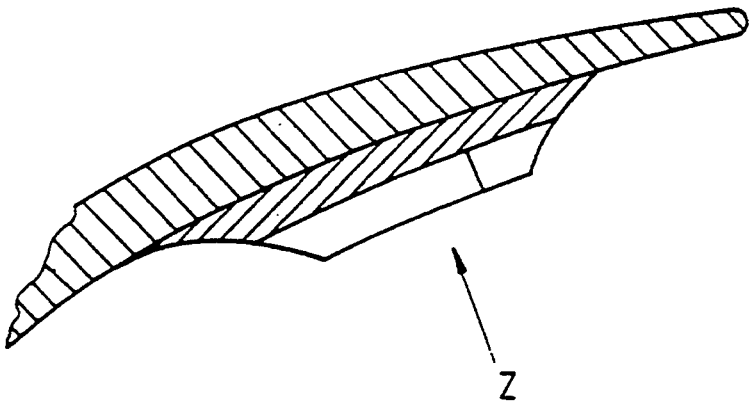
FIG. 6 is an enlarged view of the detail A of FIG. 5.
Figure 7:
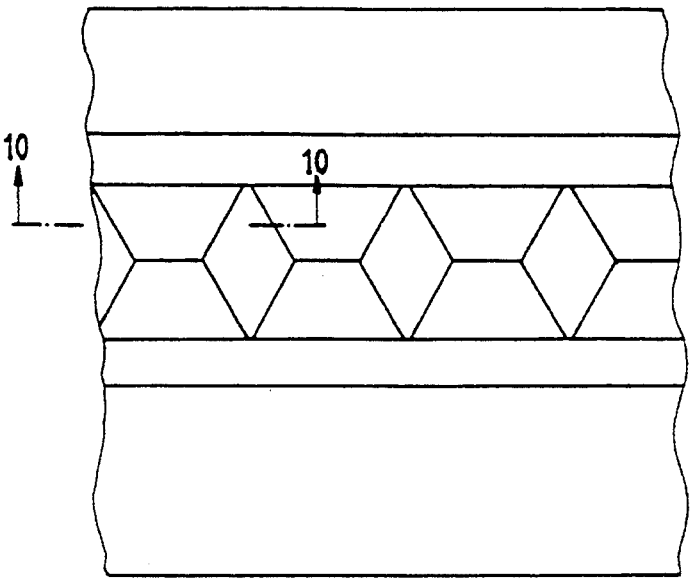
FIG. 7 shows a top view of the detail of FIG. 6.
Figure 8:
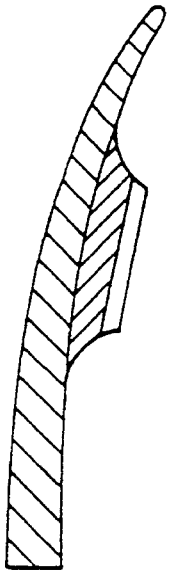
FIG. 8 shows a side sectional view of the object of FIG. 7, similar to the object of FIG. 6.
Figure 9:
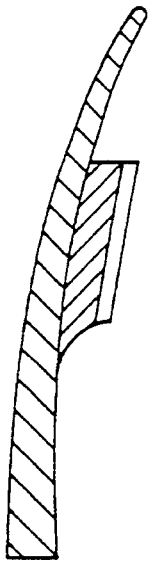
FIG. 9 shows another embodiment of the object of FIG. 8.
Figure 10A:
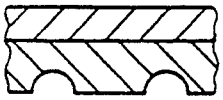
FIG. 10 shows three variants 10*a*, 10*b*, and 10*c* of views 10—10 of FIG. 7.
Figure 10B:
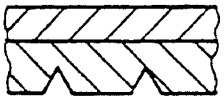
Figure 10C:
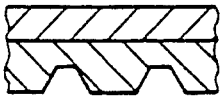
Figure 11A:
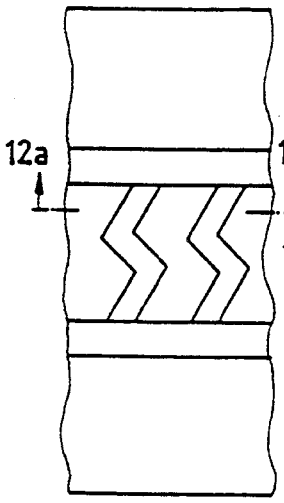
FIG. 11 shows four variants 11*a*, 11*b*, 11*c*, and 11*d* of views corresponding to FIG. 7. The variant according to FIG. 11*a*, as is apparent, has slit-like flow paths. As can be further seen, widening and narrowing flow channels are also possible, as in FIGS. 11*b* and 11*c*. It is also possible to employ Venturi-like flow channels in which a constriction is provided, followed by an expansion.
Figure 11B:
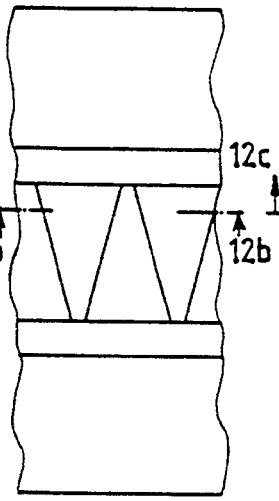
Figure 11C:
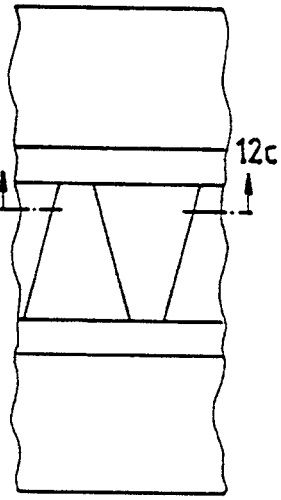
Figure 11D:
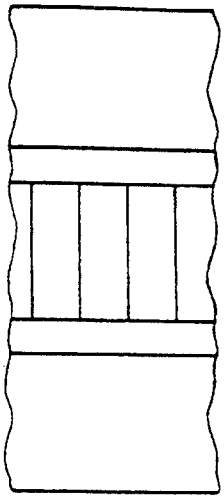
Figure 12A:
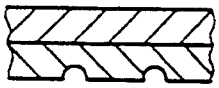
FIGS. 12*a*, 12*b*, and 12*c* show views in the direction 12*a*—12*a*, 12*b*—12*b* and 12*c*—12*c* of FIGS. 11*a*, 11*b*, and 11*c*, respectively.
Figure 12B:
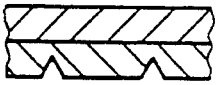
Figure 12C:
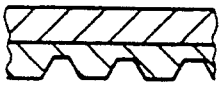
Figure 13:
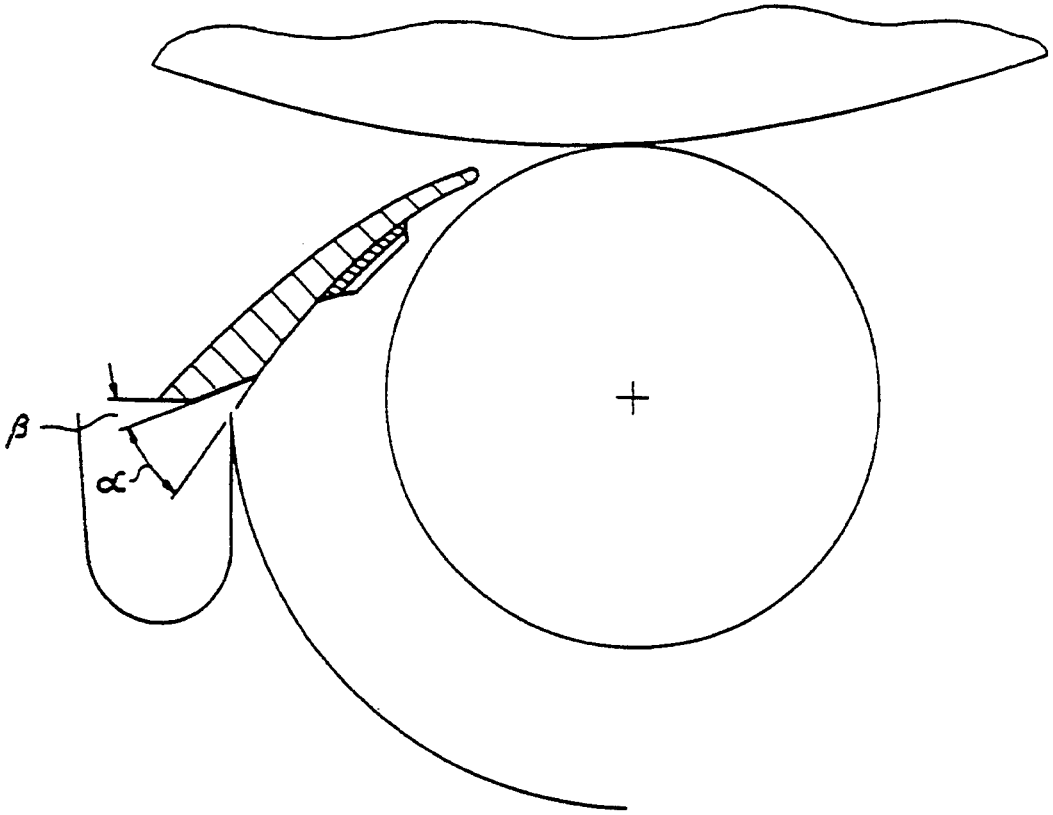
FIG. 13 shows another embodiment of a roll-coating machine of the invention.
Figure 14:
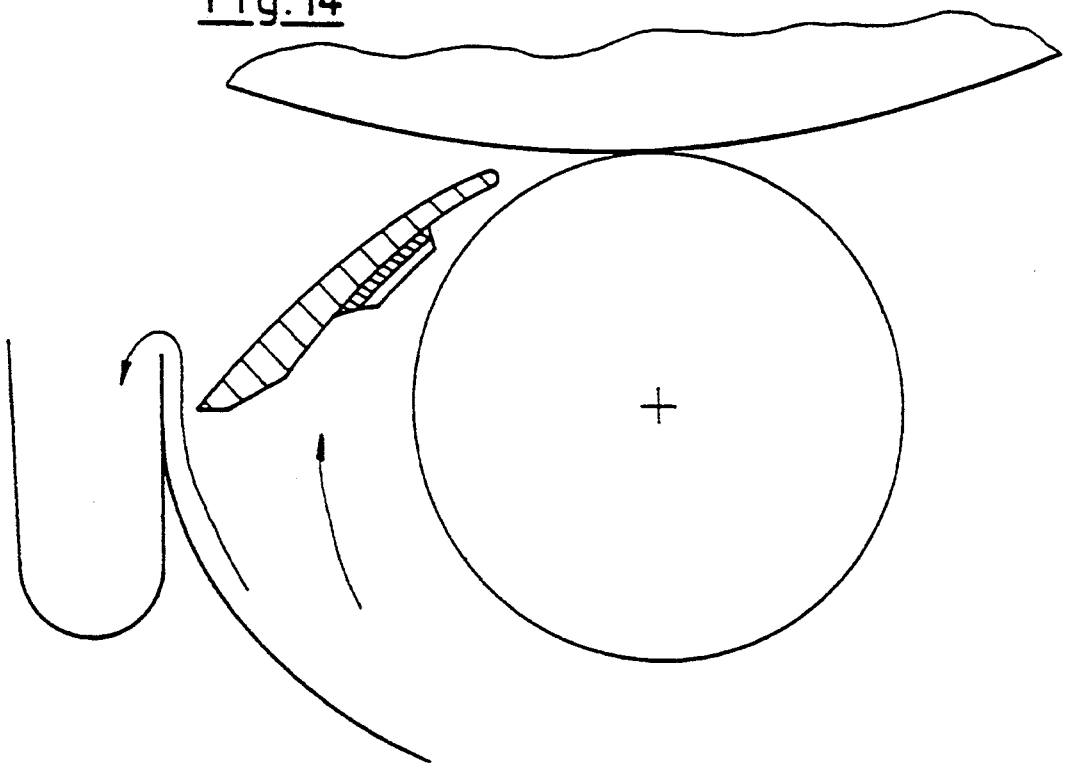
FIG. 14 shows still another embodiment of a roll-coating machine of the invention.

The embodiment of FIG. 4 is particularly preferred. In this case the guide shield 20 defines an air guide surface 26 and has a flat restrictor 24 that extends over a portion of the periphery of the mating roll 4. Alternatively, the surface of the guide shield 20 facing the paper web 5 could have the contour 27 shown with the dashed line.

In addition, an air evacuation channel 28 is of primary importance and extends between the restrictor 24 (or 27) and the lower end of the air guide surface 26 (and thus also at the lower end of the flow channel 23).

The embodiment of FIG. 4 functions as follows. During rotation of the two rolls 1 and 4 the paper web 5 entrains a stream of air as shown by the arrows 29. This air stream is deflected on an edge 33 of the guide shield 20, fed to the air guide surface 26 and thus diverted until it reaches the lower end of the air evacuation channel 28. The air is deflected there from the channel 26 and thus also from the restrictor 24 according to the ejector principle.

FIGS. 5 through 14 show interesting variants in the design of the guide shield. Together with the surface of the coating roll 1 of FIGS. 1, 3 and 4 this guide shield forms a flow channel.

According to FIGS. 5 through 14, the guide shield 20 has protrusions such as fins on its side facing the surface of the coating roll 1 that extend in the longitudinal direction of flow and are disposed in large number over the width of the machine. This results in numerous individual flow channels which may include narrowed flow regions, widened flow regions, or both. For example, these can have a zig-zag shape, they can expand, they can narrow, or they can be arranged in the fashion of Venturi nozzles.

The entire roll-coating machine can have a total of three overflow edges at which the color streams can overflow. The first overflow stream, which enters the overflow channel via the first overflow edge from the trough, can be of a selected size depending on need, and can tend toward zero in the extreme case. The second overflow stream, i.e., the one which flows over the second overflow edge through the bypass channel, will generally be relatively large. Its size can be set by the valve disposed in the bypass channel. The third overflow stream (on the restrictor) can tend toward zero, if desired. All the overflow streams discussed above suitably discharge into a single overflow channel, namely into the channel that is connected to the first overflow edge. An additional air doctor can be connected to the guide shield for safety and even further removed from the inlet gusset relative to the second and third overflow edges.

It is particularly advantageous to provide the guide shield (viewed from the side) with a special air guide surface on the side at which the paper web enters the inlet gusset. This air guide surface may extend from the beginning of the restrictor, which can also form an overflow edge, to the end of the bypass channel. It is preferably concave.

In particular, the following effects occur according to the invention.

The air stream arriving with the paper web encounters the edge of the air guide surface present there, where it is deflected, and follows the concave air guide surface of the guide shield. The air stream is diverted by this guide surface and fed to the outlet end of the bypass channel where an ejector effect occurs. The air stream sweeps out the coating color stream still flowing in the bypass channel in the fashion of a water jet nozzle, as well as any air that might still be present in the bypass channel.

In a particularly preferred embodiment, the guide shield is provided with an air suction channel that begins in the region of the restrictor and ends in the region of the end of the air guide surface. This air suction channel is therefore subject to the ejector action of the air stream diverted from the air guide surface. This air stream drains the air from the air suction channel and thus also from the restrictor, evacuating it. This ensures that any remaining amounts of air that initially enter the restrictor are drawn off before they reach the bypass channel, let alone further. This evacuation is therefore still connected to the bypass channel in order to achieve particular reliability relative to freedom from air. One advantage is that this evacuation occurs automatically. Its action adjusts even with increasing speed, which is naturally particularly favorable.

The foregoing detailed description is given for clearness of understanding only, and no unnecessary limitations should be understood therefrom, as modifications within the scope of the invention will be apparent to those skilled in the art.

I claim:

1. A roll-coating machine for the application of coating colors onto a paper web, comprising:

(a) a coating roll that rotates in a coating color pool;

(b) a trough to receive the color pool and having a coating color inlet, a guide wall in a spaced relationship with the ascending region of said coating roll with a first overflow edge, and an overflow channel connected thereto for a first overflow stream;

(c) a mating roll that is wound with a paper web and defines a nip entrance zone and a nip exit zone in cooperation with said coating roll, and rotates in a direction opposite that of said coating roll; and (d) a machine-wide guide shield that extends into said nip entrance zone, forms a flow channel in cooperation with the surface of said coating roll, and has a second overflow edge for a second overflow stream on its downstream end, wherein said guide shield has a bypass channel equipped with a valve on its downstream end to divert the second overflow stream in the direction of said valve;

said guide shield forms a restrictor with said paper web at a location forward of the bypass channel relative to the direction of rotation of the mating roll;

the restrictor defines a third overflow edge for a third overflow stream; and the guide shield has fin- or rib-like protrusions on its side facing the surface of the coating roll that extend in the direction of flow and form individual channels between them.

2. The roll-coating machine of claim 1 wherein said valve is controllable.

3. The roll-coating machine of claim 1 wherein the bypass channel discharges into said overflow channel.

4. The roll-coating machine of claim 1 wherein the drawbar is variably positionable.

5. The roll-coating machine of claim 4 wherein the drawbar can be swiveled around an axis that runs parallel to the axis of rotation of the coating roll, and wherein said axis is disposed adjacent the overflow edge of the drawbar.

6. The roll-coating machine of claim 5 wherein the individual channels include narrowed flow regions, widened flow regions, or both.

* * * * *